US009371505B2

(12) United States Patent
Tan et al.

(10) Patent No.: US 9,371,505 B2
(45) Date of Patent: Jun. 21, 2016

(54) STRUCTURED PARTICLES COMPRISING AN AMPHIPHILIC GRAFT COPOLYMER, AND GRANULAR LAUNDRY DETERGENT COMPRISING THE SAME

(71) Applicant: The Procter & Gamble Company, Cincinnati, OH (US)

(72) Inventors: HongSing Tan, Beijing (CN); Daitao Geng, Beijing (CN)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 14/794,836

(22) Filed: Jul. 9, 2015

(65) Prior Publication Data

US 2016/0010032 A1 Jan. 14, 2016

(30) Foreign Application Priority Data

Jul. 11, 2014 (WO) ..... PCT/CN2014/082019

(51) Int. Cl.

| | |
|---|---|
| ***C11D 3/10*** | (2006.01) |
| ***C11D 3/34*** | (2006.01) |
| ***C11D 17/06*** | (2006.01) |
| ***C11D 3/04*** | (2006.01) |
| ***C11D 3/37*** | (2006.01) |
| ***C11D 3/12*** | (2006.01) |

(52) U.S. Cl.

CPC *C11D 3/046* (2013.01); *C11D 3/10* (2013.01); *C11D 3/122* (2013.01); *C11D 3/34* (2013.01); *C11D 3/37* (2013.01); *C11D 3/3707* (2013.01); *C11D 3/3761* (2013.01); *C11D 3/3788* (2013.01); *C11D 17/06* (2013.01)

(58) Field of Classification Search

CPC ..... C11D 3/10; C11D 3/34; C11D 3/3788; C11D 17/06

See application file for complete search history.

(56) References Cited

U.S. PATENT DOCUMENTS

| | | | |
|---|---|---|---|
| 7,811,980 | B1 | 10/2010 | Tantawy et al. |
| 8,143,209 | B2 | 3/2012 | Boeckh et al. |
| 2009/0005287 | A1 | 1/2009 | Boutique et al. |
| 2009/0005288 | A1 | 1/2009 | Boutique et al. |
| 2009/0023625 | A1 | 1/2009 | Tang et al. |
| 2011/0152161 | A1 | 6/2011 | Murkunde et al. |
| 2013/0252874 | A1 | 9/2013 | Hulskotter et al. |

FOREIGN PATENT DOCUMENTS

| | | | | |
|---|---|---|---|---|
| EP | 2 338 970 | A1 | 6/2011 | |
| GB | 2 304 726 | A | 3/1997 | |
| GB | 2304726 | * | 3/1997 | ..... C11D 3/37 |

OTHER PUBLICATIONS

International Search Report; International Application No. PCT/CN2014/082019; date of mailing Apr. 20, 2015; 5 pages.

* cited by examiner

*Primary Examiner* — Brian P Mruk

(74) *Attorney, Agent, or Firm* — John T. Dipre; Steven W. Miller

(57) ABSTRACT

This invention relates to structured particles suitable for use in granular laundry detergent compositions, which contain an amphiphilic graft copolymer in combination with water-soluble alkali metal carbonate and sulfate particles and which contain little or no zeolite.

12 Claims, 3 Drawing Sheets

STRUCTURED PARTICLES COMPRISING AN AMPHIPHILIC GRAFT COPOLYMER, AND GRANULAR LAUNDRY DETERGENT COMPRISING THE SAME

FIELD OF THE INVENTION

The present invention relates to structured particles containing amphiphilic graft copolymers, which are formed by an agglomeration process and are particularly suitable for use in forming granular laundry detergent products.

BACKGROUND OF THE INVENTION

In laundry detergents, certain polymers are utilized as soil detachment-promoting additives, which can assist fabric cleaning in addition to surfactants. These polymers may be suitable for use in the laundry liquor as dispersants of soil pigments such as clay minerals or soot, and/or as additives which prevent the reattachment of soil to the fabric being laundered. However, these polymeric dispersants may be ineffective in the removal of hydrophobic soil from textiles, particularly when they are utilized under low temperature washing conditions.

Amphiphilic graft copolymers described in US Patent Applications No. 2009/0005288A1 and 2009/0005287A1 are particularly suited for the removal of hydrophobic soil from fabric in the wash liquor. Consequently, it would be very desirable to provide a granular laundry detergent composition comprising such polymers.

Because such amphiphilic graph copolymers are highly viscous and difficult to handle, they have been in the past provided as polymeric solutions, which is either mixed with surfactant slurry to form blown powders through a spray-drying process or is directly sprayed onto already-formed surfactant particles to form a coating layer thereover.

However, when the amphiphilic graph copolymers form a part of the surfactant granules, it is very difficult to freely adjust the levels of such copolymers in the finished products, without affecting the surfactant activity of the finished products. It is therefore desirable to form granules or particles that contain only the amphiphilic graph copolymers, with little or no surfactant therein.

US2011/0152161 discloses surfactant-free agglomerates containing about 23% amphiphilic graft copolymers ("AGPs") in combination with about 48.5% sodium carbonate and 20% zeolite. One of the biggest drawbacks to use zeolite in granular laundry detergents is cost. Therefore, such a high level of zeolite in the agglomerates disclosed by US2011/0152161 will drive up the overall manufacturing costs significantly, and will not meet the consumer demands for low-cost detergents.

Zeolite is a porous material with very high active surface area and correspondingly a large liquid loading capacity. Without the structural support of zeolite in the agglomerates, it is questionable whether solid agglomerates can be formed at all, e.g., the resulting mixture may be a viscous paste or slurry. Even if solid agglomerates are formed, it is likely that a significant amount of such agglomerates will be "oversized" particles, i.e., having particle sizes that are above a standard particle size range, e.g., from about 150 microns to about 1200 microns or preferably from about 250 microns to about 1000 microns. For the granular or powder-type laundry detergent products, it is important to ensure that all of the granules or particles in such products are within the standard particle size range, because granular or powder products with a more uniform particle size distribution have a more refined, high-quality appearance. Further, when the granules or particles are more similar in particle sizes, they are less likely to segregate during shipping and handling. Therefore, it is a typical practice in agglomeration process to remove either undersized particles (i.e., fines with particle sizes smaller than 150 or 250 microns) or oversized particles (i.e., overs with particle sizes larger than 1000 or 1200 microns). Such removed fines or overs will be recycled, processed (e.g., by grinding the oversized particles down to smaller-sized particles) and added back into the manufacturing process stream. For a specific manufacturing process, the higher amount of fines or overs is generated, the more energy will be consumed and the higher the cost will be in order to turn a unit amount of raw materials into finished products. Corresponding, a person ordinarily skilled in the art will be reluctant to reduce the amount of zeolite used in the agglomeration process, for fear of significantly increasing the amount of oversized particles generated and driving up the processing cost.

Further, the agglomerates formed with less zeolite may have a higher tendency to "cake" and a poorer flowability, which will render consumer use of the finished products more difficult and inconvenient. Therefore, a person ordinarily skilled in the art will be reluctant to reduce the amount of zeolite used in the agglomeration process, for fear of There is currently a need to provide surfactant-free particles containing the amphiphilic graft copolymers, which can be formed by an agglomeration process at relatively low cost, i.e., without using zeolite as a builder, but at the same time without generating a significant higher amount of oversized particles and without compromising flowability of the agglomerates so formed.

SUMMARY OF THE INVENTION

It is a surprising discovery of the present invention that such a need can be met by using a water-soluble alkali metal sulfate, such as sodium sulfate, to replace zeolite in forming the surfactant-free particles containing the amphiphilic graft copolymers. The water-soluble alkali metal sulfate, e.g., sodium sulfate, can be obtained at a significant lower cost than zeolite. However, it has not been used in the past to replace zeolite, because its active surface area is much smaller than that of zeolite. In turn, its liquid loading capacity is significantly lower than zeolite. A person ordinarily skilled in the art would not have been motivated to replace zeolite with sodium sulfate, due to concerns for potential generation of large amounts of oversized particles during the agglomeration process and formation of agglomerates with poor flowability. Inventors of the present invention have unexpectedly found that despite the significant difference in loading capacity between zeolite and sulfate, surfactant-free agglomerates formed using sodium sulfate contains a comparable amount of over-sized particles and has a comparable flowability as those agglomerates formed using zeolite. This finding enables successful replacement of zeolite with sodium sulfate or other similar water-soluble alkali metal sulfates, which in turn leads to significant cost reduction in the manufacturing process.

In one aspect, the present invention relates to a structured particle containing:

(a) from about 10 wt % to about 30 wt % of an amphiphilic graft copolymer having a polyalkylene oxide backbone grafted with one or more side chains selected from the group consisting of polyvinyl acetate, polyvinyl propionate, polyvinyl butyrate, and combinations thereof, while the amphiphilic graft copolymer has an average of no more than 1 graft site per 50 alkylenexoxide units;

(b) from about 30 wt % to about 80 wt % of a water-soluble alkali metal carbonate, which is in a particulate form characterized by a particle size distribution Dw50 ranging from about 10 microns to about 100 microns, preferably from about 50 microns to about 95 microns, and more preferably from about 70 microns to about 90 microns; and (c) from about 10 wt % to about 40 wt % of a water-soluble alkali metal sulfate, which is in a particulate form characterized by a particle size distribution Dw50 ranging from about 50 microns to about 250 microns, preferably from about 80 microns to about 240 microns, and more preferably from about 180 microns to about 220 microns.

The above-described structured particle is characterized by a particle size distribution Dw50 ranging from about 250 microns to about 1000 microns and a bulk density ranging from about 500 to about 1500 g/L. Further, such structured particle has a total surfactant level of from 0 wt % to about 5 wt % and contains from 0 wt % to about 5 wt % of zeolite. Preferably but not necessarily, the water-soluble alkali metal carbonate and the water-soluble alkali metal sulfate are mixed together in a mechanical mixer in presence of the amphiphilic graft copolymer to form the structured particle by agglomeration.

In another aspect, the present invention relates to a structured particle that contains:

(a) from about 20 wt % to about 25 wt % of an amphiphilic graft copolymer having a polyethylene oxide backbone grafted with one or more side chains of polyvinyl acetate, while the amphiphilic graft copolymer has an average of no more than 1 graft site per 50 ethyleneoxide units and;

(b) from about 40 wt % to about 60 wt % of sodium carbonate particles having a particle size distribution Dw50 ranging from about 180 microns to about 220 microns;

(c) from about 15 wt % to about 25 wt % of sodium sulfate particles having a particle size distribution Dw50 ranging from about 70 microns to about 90 microns; and (d) from about 2 wt % to about 4 wt % of a nonionic surfactant that is a $C_8$-$C_{16}$ alkyl alkoxylated alcohol or $C_8$-$C_{16}$ alkyl alkoxylate.

The above-described structured particle is characterized by a particle size distribution Dw50 ranging from about 250 microns to about 1000 microns and a bulk density ranging from about 500 to about 1500 g/L. Further, it has a moisture content of less than 4 wt % and contains less than 0.5 wt % of zeolite.

Yet another aspect of the present invention relates to a granular detergent composition containing from about 1 wt % to about 10 wt % of the above-described structured particles. Such a granular detergent composition may further contain from about 1 wt % to about 99 wt % of one or more surfactants, which are, for example, anionic surfactants, cationic surfactants, nonionic surfactants, amphoteric surfactants, and/or mixtures thereof.

Still another aspect of the present invention relates to a method of forming structured particles, which includes the steps of:

(a) providing from about 10 part to about 30 parts, by a total weight of 100 parts, of an amphiphilic graft copolymer having a polyalkylene oxide backbone grafted with one or more side chains selected from the group consisting of polyvinyl acetate, polyvinyl propionate, polyvinyl butyrate, and combinations thereof, while the amphiphilic graft copolymer has an average of no more than 1 graft site per 50 alkylenexoxide units, and while such amphiphilic graft copolymer is in a paste form; and (b) mixing the paste form of amphiphilic graft copolymer with from about 30 parts to about 80 parts of a water-soluble alkali metal carbonate and from about 10 parts to about 40 parts of a water-soluble alkali metal sulfate, by a total weight of 100 parts, to form structured particles, while the water-soluble alkali metal carbonate is in a particulate form having a particle size distribution Dw50 ranging from about 10 microns to about 35 microns, while the water-soluble alkali metal sulfate is in a particulate form characterized by a particle size distribution Dw50 ranging from about 50 microns to about 150 microns, The structured particles so formed are characterized by a particle size distribution Dw50 ranging from about 250 microns to about 1000 microns and a bulk density ranging from about 500 to about 1500 g/L.

These and other aspects of the present invention will become more apparent upon reading the following drawings and detailed description of the invention.

DETAILED DESCRIPTION OF THE INVENTION

Figure 1:
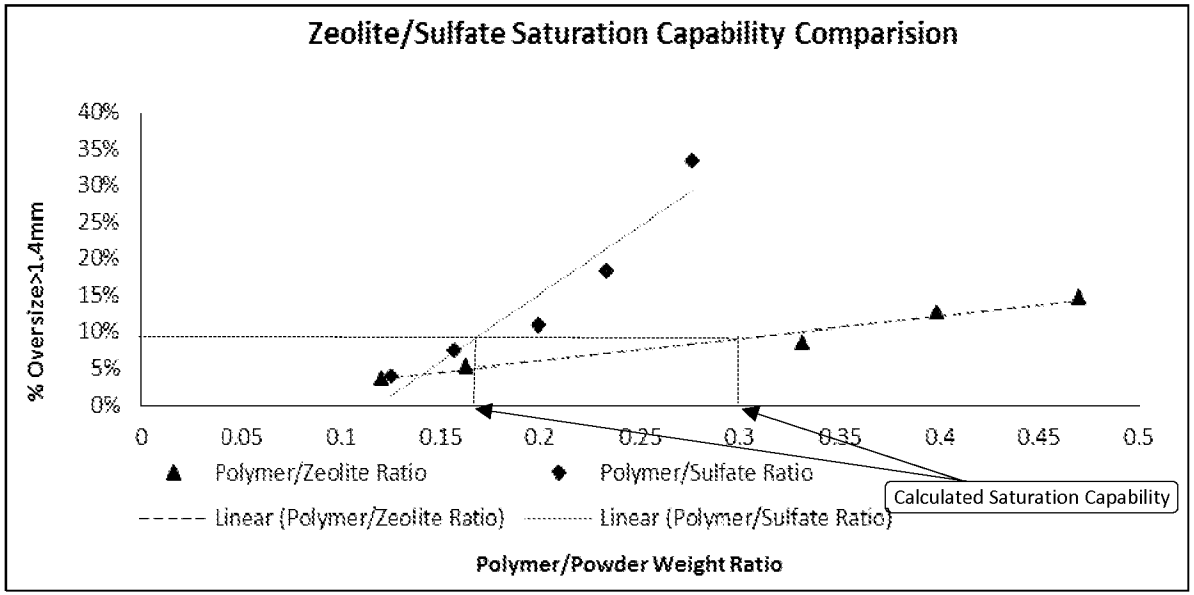
FIG. 1 is a graph showing saturation capability (or loading capacity) curves of zeolite powder and sodium sulfate powder plotted using an amphiphilic graft copolymer of the present invention.

As used herein, articles such as "a" and "an" when used in a claim, are understood to mean one or more of what is claimed or described. The terms "include", "includes" and "including" are meant to be non-limiting.

As used herein, the term "a granular detergent composition" refers to a solid composition, such as granular or powder-form all-purpose or heavy-duty washing agents for fabric, as well as cleaning auxiliaries such as bleach, rinse aids, additives, or pre-treat types.

The term "structured particle" as used herein refers to a particle with discrete particle shape and size, preferably an agglomerate particle.

The term "bulk density" as used herein refers to the uncompressed, untapped powder bulk density, as measured by the Bulk Density Test specified hereinafter.

The term "particle size distribution" as used herein refers to a list of values or a mathematical function that defines the relative amount, typically by mass or weight, of particles present according to size, as measured by the Sieve Test specified hereinafter.

As used herein, the term "substantially free" means that that the component of interest is present in an amount less than 0.5% by weight, and preferably less than 0.1% by weight.

In all embodiments of the present invention, all percentages or ratios are calculated by weight, unless specifically stated otherwise. The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Structured Particles

The present invention relates to a structured particle that comprises an amphiphilic graft copolymer, a water-soluble alkali metal carbonate and a water-soluble alkali metal sulfate.

Such structured particle is particularly characterized by a particle size distribution Dw50 of from about 250 microns to about 1000 microns, preferably from about 300 microns to about 800 microns, more preferably from about 400 microns to about 600 microns. The bulk density of such structured particles may range from 500 g/L to 1500 g/L, preferably from 600 g/L to 1000 g/L, more preferably from 700 g/L to 800 g/L.

The structured particle of the present invention has a total surfactant content of from 0 wt % to about 5 wt %, and preferably from 0 wt % to about 4 w %. It contains from 0 wt % to about 5 wt % of zeolite, preferably from 0 wt % to about 3 wt %, more preferably from 0 wt % to about 1 wt %, and most preferably from 0 wt % to about 0.1 wt %. The moisture content of such structured particle is preferably less than 4 wt %, more preferably less than 3 wt %, and most preferably less than 2 wt %.

The structured particle preferably contains little or no phosphate, e.g., from 0 wt % to about 5 wt %, more preferably from 0 wt % to about 3 wt %, and most preferably from 0 wt % to about 1 wt %.

All the above-described weight percentages in this section are calculated based on the total weight of the structured particle.

Amphiphilic Graft Copolymer(s)

The amphiphilic graft copolymers useful for the practice of the present invention are characterized by a polyalkylene oxide (also referred to as poyalkylene glycol) backbone grafted with one or more side chains.

The polyalkylene oxide backbone of the amphiphilic graft copolymers of the present invention may comprise repeated units of $C_2$-$C_{10}$, preferably $C_2$-$C_6$, and more preferably $C_2$-$C_4$, alkylene oxides. For example, the polyalkylene oxide backbone may be a polyethylene oxide (PEO) backbone, a polypropylene oxide (PPO) backbone, a polybutylene oxide (PBO) backbone, or a polymeric backbone that is a linear block copolymer of PEO, PPO, and/or PBO, while the PEO backbone is preferred. Such a polyalkylene oxide backbone preferably has a number average molecular weight of from about 2,000 to about 100,000 Daltons, more preferably from about 4,000 to about 50,000 Daltons, and most preferably from about 5,000 to about 10,000 Daltons.

The one or more side chains of the amphiphilic graft copolymers of the present invention are formed by polymerizations of vinyl esters of $C_2$-$C_{10}$, preferably $C_2$-$C_6$, and more preferably $C_2$-$C_4$, carboxylic acids. For example, the one or more side chains may be selected from the group consisting of polyvinyl acetate, polyvinyl propionate, polyvinyl butyrate, and combinations thereof, while polyvinyl acetate is preferred. The polyvinyl ester side chains may be partially saponified, for example, to an extent of up to 15%. The amphiphilic graft copolymer is preferably characterized by an average of no more than 1 graft site (i.e., the site on the polymeric backbone where a polyvinyl ester side chain is grafted thereto) per 50 alkyleneoxide units on the backbone.

The amphiphilic graft copolymers of the present invention may have an overall mean molar masses ($M_w$) of from about 3000 to about 100,000 Daltons, preferably from about 10,000 to about 50,000 Daltons, and more preferably from about 20,000 to about 40,000 Daltons.

Particularly preferred amphiphilic graft copolymers of the present invention have a polyethylene oxide backbone grafted with one or more side chains of polyvinyl acetate. More preferably, the weight ratio of the polyethylene oxide backbone over the polyvinyl acetate side chains ranges from about 1:0.2 to about 1:10, or from about 1:0.5 to about 1:6, and most preferably from about 1:1 to about 1:5. One example of such preferred amphiphilic graft copolymers is the Sokalan™ HP22 polymer, which is commercially available from BASF Corporation. This polymer has a polyethylene oxide backbone grafted with polyvinyl acetate side chains. The polyethylene oxide backbone of this polymer has a number average molecular weight of about 6,000 Daltons (equivalent to about 136 ethylene oxide units), and the weight ratio of the polyethylene oxide backbone over the polyvinyl acetate side chains is about 1:3. The number average molecular weight of this polymer itself is about 24,000 Daltons.

Preferably, but not necessarily, the amphiphilic graft copolymers of the present invention have the following properties: (i) the surface tension of a 39 ppm by weight polymer solution in distilled water is from about 40 mN/m to about 65 mN/m as measured at 25° C. by a tensiometer; and (ii) the viscosity of a 500 ppm by weight polymer solution in distilled water is from about 0.0009 to about 0.003 Pa·S as measured at 25° C. by a rheometer. The surface tension of the polymer solution can be measured by any known tensiometer under the specified conditions. Non-limiting tensiometers useful herein include Kruss tensiomerter available from Kruss, Thermo DSCA322 tensiometer from Thermo Cahn, or Sigma 700 tensiometer from KSV Instrument Ltd. Similarly, the viscosity of the polymer solution can be measured by any known rheometer under the specified conditions. The most commonly used rheometer is a rheometer with rotational method, which is also called a stress/strain rheometer. Non-limiting rheometers useful herein include Hakke Mars rheometer from Thermo, Physica 2000 rheometer from Anton Paar.

Selected embodiments of the amphiphilic graft copolymers for use in the present invention as well as methods of making them are described in detail in PCT Patent Application No. WO 2007/138054, US Patent Application No. 2011/0152161, US Patent Application No. 2009/0023625, U.S. Pat. No. 8,143,209, and US Patent Application No. 2013/025874.

The amphiphilic graft copolymer(s) is present in the structured particles of the present invention in an amount ranging from about 10 wt % to about 30 wt %, or preferably from about 20 wt % to about 25 wt %, by total weight of the structured particles.

Water-Soluble Alkali Metal Carbonate

The structured particles of the present invention may also contain a water-soluble alkali metal carbonate. Suitable alkali metal carbonate that can be used for practice of the present invention include, but are not limited to, sodium carbonate, potassium carbonate, sodium bicarbonate, and potassium bicarbonate (which are all referred to as "carbonates" or "carbonate" hereinafter). Sodium carbonate is particularly preferred. Potassium carbonate, sodium bicarbonate, and potassium bicarbonate can also be used.

The water-soluble alkali metal carbonate may be used in the structured particles at an amount ranging from about 30 wt % to about 80 wt %, preferably from 40 wt % to about 60 wt %, and preferably from about 45 wt % to about 55 wt %, measured by total weight of the structured particles.

The water-soluble alkali metal carbonate is in a particulate form and is preferably characterized by a particle size distribution Dw50 ranging from about 10 microns to about 100 microns, more preferably from about 50 microns to about 95 microns, and most preferably from about 70 microns to about 90 microns. Particle size of the carbonate may be reduced by a milling, grinding or a comminuting step down to a Dw50 range of from about 10 microns to about 35 microns, using any apparatus known in the art for milling, grinding or comminuting of granular or particulate compositions. In a particularly preferred embodiment of the present invention, the structured particles comprise sodium carbonate particles having Dw50 ranging from about 70 microns to about 90 microns in an amount ranging from about 40 wt % to about 60 wt %.

Water-Soluble Alkali Metal Sulfate

The structured particles of the present invention comprise one or more water-soluble alkaline metal sulfates, which is used to replace zeolite in conventional structured particles to form surfactant-free structured particles that contain the above-described amphiphilic graft copolymers, but with low or nil zeolite.

As explained hereinabove, it is an unexpected and surprising finding of the present invention that such water-soluble alkaline metal sulfates can be used to replace zeolite in forming surfactant-free or low-surfactant structured particles that contain the amphiphilic graft copolymers through an agglomeration process, without significantly increasing the amount of oversized particles generated by such process and without compromising the flowability of the structured particles so formed. The water-soluble alkali metal sulfate, e.g., sodium sulfate, is known to have a much smaller active surface area and a significantly lower liquid loading capacity than zeolite. Conventional wisdom believes that when everything else holds equal during an agglomeration process, the replacement of a material of larger active surface area and higher liquid loading capacity with a material of smaller active surface area and lower liquid loading capacity would have generated a significantly greater amount of oversized particles and produced agglomerates with poorer flowability, which are highly undesirable and therefore have prevented a person ordinarily skilled in the art from replacing zeolite with water-soluble alkali metal salts, such as sodium sulfate. However, inventors have found that when such replacement of zeolite by sodium sulfate is done in an agglomeration process for forming a surfactant-free or low-surfactant structured particle that contain the specific amphiphilic graft copolymers according to the present invention, the agglomeration process generates a comparable amount of over-sized particles, and the structured particles so formed have a comparable flowability as those formed using zeolite. This finding, as surprising and unexpected as it is, allows successful replacement of zeolite with sodium sulfate or other similar water-soluble alkali metal sulfates, which results in significant reduction of raw material cost, but without increasing the manufacturing costs or compromising the product quality.

The water-soluble alkaline metal sulfates can be selected from the group consisting of sodium sulfate, potassium sulfate, sodium bisulfate, potassium bisulfate, and the like. Sodium sulfate is particularly preferred.

The water-soluble alkali metal sulfate may be used in the structured particles at an amount ranging from about 10 wt % to about 40 wt %, preferably from 10 wt % to about 30 wt %, and preferably from about 15 wt % to about 25 wt %, measured by total weight of the structured particles.

The water-soluble alkali metal sulfate is in a particulate form and is preferably characterized by a particle size distribution Dw50 ranging from about 50 microns to about 250 microns, more preferably from about 80 microns to about 240 microns, and most preferably from about 180 microns to about 220 microns. In a particularly preferred embodiment of the present invention, the structured particles comprise sodium sulfate particles having Dw50 ranging from about 180 microns to about 220 microns in an amount ranging from about 15 wt % to about 25 wt %.

Nonionic Surfactant

A small amount of one or more nonionic surfactants, e.g., in the range of from 0 wt % to about 5 wt %, preferably from about 2 wt % to about 4%, can also be used in forming the structured particles of the present invention. Suitable nonionic surfactants can be selected from the group consisting of: alkyl polyglucoside; $C_8$-$C_{16}$ alkyl alkoxylated alcohols; $C_8$-$C_{16}$ alkyl alkoxylates, such as, NEODOL® non-ionic surfactants from Shell; $C_8$-$C_{16}$ alkyl phenol alkoxylates wherein the alkoxylate units are ethyleneoxy units, propyleneoxy units or a mixture thereof; $C_8$-$C_{16}$ alcohol and $C_8$-$C_{16}$ alkyl phenol condensates with ethylene oxide/propylene oxide block polymers such as Pluronic® from BASF; $C_{14}$-$C_{22}$ mid-chain branched alcohols, BA, as described in more detail in U.S. Pat. No. 6,150,322; $C_{14}$-$C_{22}$ mid-chain branched alkyl alkoxylates, BAEx, wherein x=from 1 to 35; alkylcelluloses, specifically alkylpolyglycosides; polyhydroxy fatty acid amides; ether capped poly(oxyalkylated) alcohol surfactants; and mixtures thereof.

A particularly preferred nonionic surfactant is a $C_8$-$C_{16}$ alkyl alkoxylated alcohol or a $C_8$-$C_{16}$ alkyl alkoxylate. In a particularly preferred embodiment of the present invention, the structured particles comprise from about 2 wt % to about 4 wt % of $C_{10}$ alkyl alkoxylated alcohol.

Other Ingredients

The structured particles of the present invention may comprise one or more organic solvents selected from the group consisting of alkylene glycols, glycol ethers, glycol ether esters, and combinations thereof. Such organic solvents are useful for solubilizing the amphiphilic graft polymer to form a polymeric solution that can be used as a binder during the agglomeration process. Therefore, the organic solvents are present in the structured particles in a relatively low amount, e.g., from about 0.1 wt % to about 5 wt %, preferably from about 0.5 wt % to about 3 wt %. Particularly preferred organic solvents include propylene glycol, dipropylene glycol, tripropylene glycol, tripropylene glycol n-butyl ether, and the like.

The structured particles may also contain, in small amounts (e.g., no more than 5 wt %), of other cleaning actives such as anionic surfactants, cationic surfactants, amphoteric surfactants, chelants, polymers, enzymes, colorants, bleaching agents, flocculation aids, and the like. However, in a preferred embodiment of the present invention, the structured particles are substantially free of other cleaning actives except those described in the preceding paragraphs.

Preferably but not necessarily, all of the above-described ingredients of the structured particles are mixed together in a mechanical mixer to form such structured particles by an agglomeration process.

Granular Detergent Composition

The above-described structured particles are particularly useful for forming granular detergent compositions. Such structured particles may be provided in a granular detergent composition in an amount ranging from 1% to 10%, preferably from 2% to 8%, and more preferably from 3% to 7% by total weight of the granular detergent composition.

The granular detergent composition may comprise one or more surfactants selected from the group consisting of anionic surfactants, cationic surfactants, nonionic surfactants, amphoteric surfactants, and mixtures thereof. Such granular detergent composition may contain only one type of anionic surfactant. It may also contain a combination of two or more different anionic surfactants, a combination of one or more anionic surfactants with one or more nonionic surfactants, a combination of one or more anionic surfactants with one or more cationic surfactants, or a combination of all three types of surfactants (i.e., anionic, nonionic, and cationic).

Anionic surfactants suitable for forming the granular detergent compositions of the present invention can be readily selected from the group consisting of $C_{10}$-$C_{20}$ linear or branched alkyl alkoxylated sulphates, $C_{10}$-$C_{20}$ linear or branched alkyl benzene sulphonates, $C_{10}$-$C_{20}$ linear or branched alkyl sulfates, $C_{10}$-$C_{20}$ linear or branched alkyl sulphonates, $C_{10}$-$C_{20}$ linear or branched alkyl phosphates, $C_{10}$-$C_{20}$ linear or branched alkyl phosphonates, $C_{10}$-$C_{20}$ linear or branched alkyl carboxylates, and salts and mixtures thereof. The total amount of anionic surfactants in the granular laundry detergent compositions may range from 5% to 95%, preferably from 10% to 70%, more preferably from 15% to 55%, and most preferably from 20% to 50%, by total weight of such compositions.

The granular laundry detergent compositions of the present invention may comprise a cationic surfactant. When present, the composition typically comprises from about 0.05 wt % to about 5 wt %, or from about 0.1 wt % to about 2 wt % of such cationic surfactant. Suitable cationic surfactants are alkyl pyridinium compounds, alkyl quaternary ammonium compounds, alkyl quaternary phosphonium compounds, and alkyl ternary sulfonium compounds. The cationic surfactant can be selected from the group consisting of: alkoxylate quaternary ammonium (AQA) surfactants; dimethyl hydroxyethyl quaternary ammonium surfactants; polyamine cationic surfactants; cationic ester surfactants; amino surfactants, specifically amido propyldimethyl amine; and mixtures thereof. Highly preferred cationic surfactants are mono-$C_{8-10}$ alkyl mono-hydroxyethyl di-methyl quaternary ammonium chloride, mono-$C_{10-12}$ alkyl mono-hydroxyethyl di-methyl quaternary ammonium chloride and mono-$C_{10}$ alkyl mono-hydroxyethyl di-methyl quaternary ammonium chloride. Cationic surfactants such as Praepagen HY (tradename Clariant) may be useful and may also be useful as a suds booster.

The granular laundry detergent compositions of the present invention may comprise one or more non-ionic surfactants in amounts of from about 0.5 wt % to about 20 wt %, and preferably from 2 wt % to about 4 wt % by total weight of the compositions. The additional nonionic surfactants can be same as those already included in the structured particles, or they can be different.

The granular detergent compositions may optionally include one or more other detergent adjunct materials for assisting or enhancing cleaning performance, treatment of the substrate to be cleaned, or to modify the aesthetics of the detergent composition. Illustrative examples of such detergent adjunct materials include: (1) inorganic and/or organic builders, such as carbonates (including bicarbonates and sesquicarbonates), sulphates, phosphates (exemplified by the tripolyphosphates, pyrophosphates, and glassy polymeric meta-phosphates), phosphonates, phytic acid, silicates, zeolite, citrates, polycarboxylates and salts thereof (such as mellitic acid, succinic acid, oxydisuccinic acid, polymaleic acid, benzene 1,3,5-tricarboxylic acid, carboxymethyloxysuccinic acid, and soluble salts thereof), ether hydroxypolycarboxylates, copolymers of maleic anhydride with ethylene or vinyl methyl ether, 1,3,5-trihydroxy benzene-2,4,6-trisulphonic acid, 3,3-dicarboxy-4-oxa-1,6-hexanedioates, polyacetic acids (such as ethylenediamine tetraacetic acid and nitrilotriacetic acid) and salts thereof, fatty acids (such as $C_{12}$-$C_{18}$ monocarboxylic acids); (2) chelating agents, such as iron and/or manganese-chelating agents selected from the group consisting of amino carboxylates, amino phosphonates, polyfunctionally-substituted aromatic chelating agents and mixtures therein; (3) clay soil removal/anti-redeposition agents, such as water-soluble ethoxylated amines (particularly ethoxylated tetraethylene-pentamine); (4) polymeric dispersing agents, such as polymeric polycarboxylates and polyethylene glycols, acrylic/maleic-based copolymers and water-soluble salts thereof of, hydroxypropylacrylate, maleic/acrylic/vinyl alcohol terpolymers, polyethylene glycol (PEG), polyaspartates and polyglutamates; (5) optical brighteners, which include but are not limited to derivatives of stilbene, pyrazoline, coumarin, carboxylic acid, methinecyanines, dibenzothiphene-5,5-dioxide, azoles, 5- and 6-membered-ring heterocycles, and the like; (6) suds suppressors, such as monocarboxylic fatty acids and soluble salts thereof, high molecular weight hydrocarbons (e.g., paraffins, haloparaffins, fatty acid esters, fatty acid esters of monovalent alcohols, aliphatic $C_{18}$-$C_{40}$ ketones, etc.), N-alkylated amino triazines, propylene oxide, monostearyl phosphates, silicones or derivatives thereof, secondary alcohols (e.g., 2-alkyl alkanols) and mixtures of such alcohols with silicone oils; (7) suds boosters, such as $C_{10}$-$C_{16}$ alkanolamides, $C_{10}$-$C_{14}$ monoethanol and diethanol amides, high sudsing surfactants (e.g., amine oxides, betaines and sultaines), and soluble magnesium salts (e.g., $MgCl_2$, $MgSO_4$, and the like); (8) fabric softeners, such as smectite clays, amine softeners and cationic softeners; (9) dye transfer inhibiting agents, such as polyvinyl pyrrolidone polymers, polyamine N-oxide polymers, copolymers of N-vinylpyrrolidone and N-vinylimidazole, manganese phthalocyanine, peroxidases, and mixtures thereof; (10) enzymes, such as proteases, amylases, lipases, cellulases, and peroxidases, and mixtures thereof; (11) enzyme stabilizers, which include water-soluble sources of calcium and/or magnesium ions, boric acid or borates (such as boric oxide, borax and other alkali metal borates); (12) bleaching agents, such as percarbonates (e.g., sodium carbonate peroxyhydrate, sodium pyrophosphate peroxyhydrate, urea peroxyhydrate, and sodium peroxide), persulfates, perborates, magnesium monoperoxyphthalate hexahydrate, the magnesium salt of metachloro perbenzoic acid, 4-nonylamino-4-oxoperoxybutyric acid and diperoxydodecanedioic acid, 6-nonylamino-6-oxoperoxycaproic acid, and photoactivated bleaching agents (e.g., sulfonated zinc and/or aluminum phthalocyanines); (13) bleach activators, such as nonanoyloxybenzene sulfonate (NOBS), tetraacetyl ethylene diamine (TAED), amido-derived bleach activators including (6-octanamidocaproyl)oxybenzenesulfonate, (6-nonanamidocaproyl)oxybenzenesulfonate, (6-decanamidocaproyl) oxybenzenesulfonate, and mixtures thereof, benzoxazin-type activators, acyl lactam activators (especially acyl caprolactams and acyl valerolactams); and (9) any other known detergent adjunct ingredients, including but not limited to carriers, hydrotropes, processing aids, dyes or pigments, and solid fillers.

In a preferred but not necessary embodiment of the present invention, the granular laundry detergent composition contains from about 0 wt % to about 1 wt % of a silicone-containing particle for foam or suds control. Such silicone-containing particle is typically formed by mixing or combining a silicone-derived anti-foaming agent with a particulate carrier material.

The silicone-derived anti-foaming agent can be any suitable organosilicones, including, but not limited to: (a) non-functionalized silicones such as polydimethylsiloxane (PDMS); and (b) functionalized silicones such as silicones with one or more functional groups selected from the group consisting of amino, amido, alkoxy, alkyl, phenyl, polyether, acrylate, siliconehydride, mercaptoproyl, carboxylate, sulphate phosphate, quaternized nitrogen, and combinations thereof. In typical embodiments, the organosilicones suitable for use herein have a viscosity ranging from about 10 to about 700,000 CSt (centistokes) at 20° C. In other embodiments, the suitable organosilicones have a viscosity from about 10 to about 100,000 CSt.

Polydimethylsiloxanes (PDMS) can be linear, branched, cyclic, grafted or cross-linked or cyclic structures. In some embodiments, the detergent compositions comprise PDMS having a viscosity of from about 100 to about 700,000 CSt at 20° C.

Exemplary functionalized silicones include but are not limited to aminosilicones, amidosilicones, silicone polyethers, alkylsilicones, phenyl silicones and quaternary silicones. The functionalized silicones suitable for use in the present invention have the following general formula:

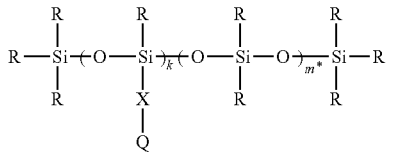

wherein m is from 4 to 50,000, preferably from 10 to 20,000; k is from 1 to 25,000, preferably from 3 to 12,000; each R is H or C1-C8 alkyl or aryl group, preferably C1-C4 alkyl, and more preferably a methyl group.

X is a linking group having the formula:

(i) —(CH2)p-, wherein p is from 2 to 6, preferably 2 to 3;

ii)

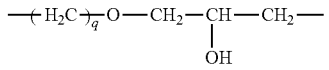

wherein q is from 0 to 4, preferably 1 to 2; or (iii)

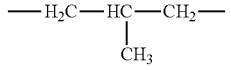

Q has the formula:

(i) —NH2, —NH—(CH2)r-NH2, wherein r is from 1 to 4, preferably 2 to 3; or (ii) —(O—CHR2-CH2)s-Z, wherein s is from 1 to 100, preferably 3 to 30;

wherein R2 is H or C1-C3 alkyl, preferably H or CH3; and Z is selected from the group consisting of —OR3, —OC(O)R3, —CO—R4-COOH, —SO3, —PO(OH)2, and mixtures thereof; further wherein R3 is H, C1-C26 alkyl or substituted alkyl, C6-C26 aryl or substituted aryl, C7-C26 alkylaryl or substituted alkylaryl groups, preferably R3 is H, methyl, ethyl propyl or benzyl groups; R4 is —CH2— or —CH2CH2— groups; and (iii)

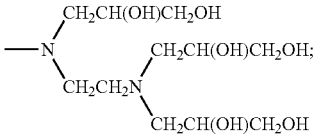

(iv)

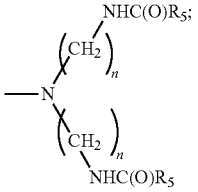

wherein each n is independently from 1 to 4, preferably 2 to 3; and R.sub.5 is C1-C4 alkyl, preferably methyl.

Another class of preferred organosilicone comprises modified polyalkylene oxide polysiloxanes of the general formula:

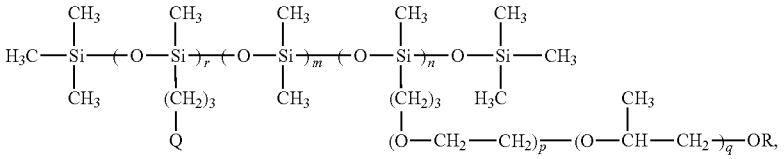

wherein Q is NH2 or —NHCH2CH2NH2; R is H or C1-C6 alkyl; r is from 0 to 1000; m is from 4 to 40,000; n is from 3 to 35,000; and p and q are integers independently selected from 2 to 30.

When r is 0, non-limiting examples of such polysiloxanes with polyalkylene oxide are Silwet® L-7622, Silwet® L-7602, Silwet® L-7604, Silwet® L-7500, Magnasoft® TLC, available from GE Silicones of Wilton, Conn.; Ultrasil® SW-12 and Ultrasil® DW-18 silicones, available from Noveon Inc., of Cleveland, Ohio; and DC-5097, FF-400® available from Dow Corning of Midland, Mich. Additional examples are KF-352®, KF-6015®, and KF-945®, all available from Shin Etsu Silicones of Tokyo, Japan.

When r is 1 to 1000, non-limiting examples of this class of organosilicones are Ultrasil® A21 and Ultrasil® A-23, both available from Noveon, Inc. of Cleveland, Ohio; BY16-876® from Dow Corning Toray Ltd., Japan; and X22-3939A® from Shin Etsu Corporation, Tokyo Japan.

A third class of preferred organosilicones comprises modified polyalkylene oxide polysiloxanes of the general formula:

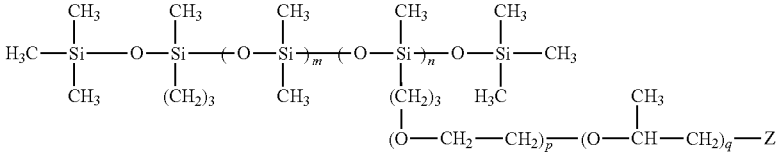

wherein m is from 4 to 40,000; n is from 3 to 35,000; and p and q are integers independently selected from 2 to 30.

Z is selected from:

(i) —C(O)—R7, wherein R7 is C1-C24 alkyl group;

(ii) —C(O)—R4-C(O)—OH, wherein R4 is CH2 or CH2CH2;

(iii) —SO3;

(iv) —P(O)OH2;

(v)

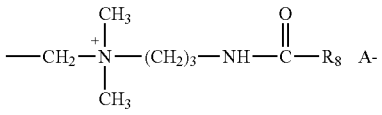

wherein R8 is C1-C22 alkyl and A- is an appropriate anion, preferably $Cl^-$;

(vi)

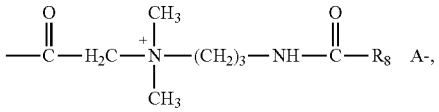

wherein R8 is C1-C22 alkyl and A- is an appropriate anion, preferably $Cl^-$.

Another class of preferred silicones comprises cationic silicones. These are typically produced by reacting a diamine with an epoxide. They are described in WO 02/18528 and WO 04/041983 (both assigned to P&G), WO 04/056908 (assigned to Wacker Chemie) and U.S. Pat. No. 5,981,681 and U.S. Pat. No. 5,807,956 (assigned to OSi Specialties). These are commercially available under the trade names Magnasoft® Prime, Magnasoft® HSSD, Silsoft® A-858 (all from GE Silicones) and Wacker SLM21200®.

Organosilicone emulsions, which comprise organosilicones dispersed in a suitable carrier (typically water) in the presence of an emulsifier (typically an anionic surfactant), can also be used as the anti-foaming agent in the present invention. In another embodiment, the organosilicones are in the form of microemulsions. The organosilicone microemulsions may have an average particle size in the range from about 1 nm to about 150 nm, or from about 10 nm to about 100 nm, or from about 20 nm to about 50 nm. Microemulsions are more stable than conventional macroemulsions (average particle size about 1-20 microns) and when incorporated into a product, the resulting product has a preferred clear appearance. More importantly, when the composition is used in a typical aqueous wash environment, the emulsifiers in the composition become diluted such that the microemulsions can no longer be maintained and the organosilicones coalesce to form significantly larger droplets which have an average particle size of greater than about 1 micron.

Suitable particulate carrier materials that can be used in forming the silicone-containing particles described hereinabove include, but are not limited to: silica, zeolite, bentonite, clay, ammonium silicates, phosphates, perborates, polymers (preferably cationic polymers), polysaccharides, polypeptides, waxes, and the like.

In a preferred but not necessary embodiment of the present invention, the silicone-containing particle used herein contains a polydimethylsiloxane or polydiorganosiloxane polymer, hydrophobic silica particles, a polycarboxylate copolymer binder, an organic surfactant, and a zeolite carrier. Suitable silicone-containing particles that are commercially available include those under the tradename Dow Corning® Antifoam from Dow Corning Corporation (Midland, Minn.).

Process for Making Structured Particles

The process of making the structured particles of the present invention, preferably in an agglomerated form, comprising the steps of: (a) providing the raw materials in the weight proportions as defined hereinabove, in either powder and/or paste forms; (b) mixing the raw materials in a mixer or granulator that is operating at a suitable shear force for agglomeration of the raw materials; (c) optionally, removing any oversize particles, which are recycled via a grinder or lump-breaker back into the process stream, e.g., into step (a) or (b); (d) the resulting agglomerates are dried to remove moisture that may be present in excess of 3 wt %, preferably in excess of 2%, and more preferably in excess of 1%; (e) optionally, removing any fines and recycling the fines to the mixer-granulator, as described in step (b); and (f) optionally, further removing any dried oversize agglomerates and recycling via a grinder to step (a) or (e).

Any suitable mixing apparatus capable of handling viscous paste can be used as the mixer described hereinabove for practice of the present invention. Suitable apparatus includes, for example, high-speed pin mixers, ploughshare mixers, paddle mixers, twin-screw extruders, Teledyne compounders, etc. The mixing process can either be carried out intermittently in batches or continuously.

Process for Making the Granular Detergent Compositions Comprising the Structured Particles The granular detergent composition, which is provided in a finished product form, can be made by mixing the structured particles of the present invention with a plurality of other particles containing the above-described surfactants and adjunct materials. Such other particles can be provided as spray-dried particles, agglomerated particles, and extruded particles. Further, the surfactants and adjunct materials can also be incorporated into the granular detergent composition in liquid form through a spray-on process.

Process for Using the Granular Detergent Compositions for Washing Fabric

The granular detergent compositions of the present invention are suitable for use in both a machine-washing or a hand-washing context. The laundry detergent is typically diluted by a factor of from about 1:100 to about 1:1000, or about 1:200 to about 1:500 by weight. The wash water used to form the laundry liquor is typically whatever water is easily available, such as tap water, river water, well water, etc. The temperature of the wash water may range from about 0° C. to about 40° C., preferably from about 5° C. to about 30° C., more preferably from 5° C. to 25° C., and most preferably from about 10° C. to 20° C., although higher temperatures may be used for soaking and/or pretreating.

Test Methods

The following techniques must be used to determine the properties of the detergent granules and detergent compositions of the invention in order that the invention described and claimed herein may be fully understood.

Test 1: Bulk Density Test

The granular material bulk density is determined in accordance with Test Method B, Loose-fill Density of Granular Materials, contained in ASTM Standard E727-02, "Standard Test Methods for Determining Bulk Density of Granular Carriers and Granular Pesticides," approved Oct. 10, 2002.

Test 2: Sieve Test

This test method is used herein to determine the particle size distribution of the structured particles or the detergent granules of the present invention. The particle size distribution of the structured particles or the detergent granules are measured by sieving the particles granules through a succession of sieves with gradually smaller dimensions. The weight of material retained on each sieve is then used to calculate a particle size distribution.

This test is conducted to determine the Median Particle Size of the subject particle using ASTM D 502-89, "Standard Test Method for Particle Size of Soaps and Other Detergents", approved May 26, 1989, with a further specification for sieve sizes used in the analysis. Following section 7, "Procedure using machine-sieving method," a nest of clean dry sieves containing U.S. Standard (ASTM E 11) sieves #8 (2360 μm), #12 (1700 μm), #16 (1180 μm), #20 (850 μm), #30 (600 μm), #40 (425 μm), #50 (300 μm), #70 (212 μm), and #100 (150 μm) is required. The prescribed Machine-Sieving Method is used with the above sieve nest. The detergent granule of interest is used as the sample. A suitable sieve-shaking machine can be obtained from W.S. Tyler Company of Mentor, Ohio, U.S.A. The data are plotted on a semi-log plot with the micron size opening of each sieve plotted against the logarithmic abscissa and the cumulative mass percent (Q3) plotted against the linear ordinate.

An example of the above data representation is given in ISO 9276-1:1998, "Representation of results of particle size analysis—Part 1: Graphical Representation", Figure A.4. The Median Weight Particle Size (Dw50) is defined as the abscissa value at the point where the cumulative weight percent is equal to 50 percent, and is calculated by a straight line interpolation between the data points directly above (a50) and below (b50) the 50% value using the following equation:

$$D_w50=10\,[\mathrm{Log}(D_{a50})-(\mathrm{Log}(D_{a50})-\mathrm{Log}(D_{b5o}))*(Q_{a5o}-50\%)/(Q_{a50}-Q_{bso})]$$

where $Q_{a50}$ and $Q_{b50}$ are the cumulative weight percentile values of the data immediately above and below the $50^{th}$ percentile, respectively; and $D_{a50}$ and $D_{b50}$ are the micron sieve size values corresponding to these data. In the event that the $50^{th}$ percentile value falls below the finest sieve size (150 μm) or above the coarsest sieve size (2360 μm), then additional sieves must be added to the nest following a geometric progression of not greater than 1.5, until the median falls between two measured sieve sizes.

Test 3: Laser Diffraction Method

This test method must be used to determine a fine powder's (e.g. raw materials like sodium carbonate and sodium sulfate) Weight Median Particle Size (Dw50). The fine powder's Weight Median Particle Size (Dw50) is determined in accordance with ISO 8130-13, "Coating powders—Part 13: Particle size analysis by laser diffraction." A suitable laser diffraction particle size analyzer with a dry-powder feeder can be obtained from Horiba Instruments Incorporated of Irvine, Calif., U.S.A.; Malvern Instruments Ltd of Worcestershire, UK; Sympatec GmbH of Clausthal-Zellerfeld, Germany; and Beckman-Coulter Incorporated of Fullerton, Calif., U.S.A.

The results are expressed in accordance with ISO 9276-1: 1998, "Representation of results of particle size analysis—Part 1: Graphical Representation", Figure A.4, "Cumulative distribution Q3 plotted on graph paper with a logarithmic abscissa." The Median Particle Size is defined as the abscissa value at the point where the cumulative distribution (Q3) is equal to 50 percent.

EXAMPLES

Example 1

Comparative Test Showing Loading Capacity Difference of Zeolite and Sodium Sulfate The zeolite particles used have a particle size distribution Dw50 of about 4 microns. The sulfate particles have a particle size distribution Dw50 of about 200 microns. The particle size distribution Dw50 is measured by Malvern Mastersizer using the Laser Diffraction Method.

The following test is conducted to assess the respective loading capacities (also referred to as saturation capabilities) of zeolite particles and sodium sulfate particles.

1.1. The saturation capability test method is conducted by following the principles described in steps 1.2 to 1.10 at below.

1.2. Weigh suitable amounts of powders, i.e., zeolite or sodium sulfate, for testing. The actual powder weights are adjusted depending on the bulk density of the powder materials, to ensure similar volumes of the zeolite powder and sodium sulfate powder are used for conducting the loading capacity test. Because zeolite powder is highly porous and finer with a smaller particle size distribution Dw50 of about 4 um, it has a significantly lower bulk density, and the corresponding amount of zeolite powder weighed for testing is about 50 grams. In contrast, the sodium sulfate powder is significantly less porous and is coarser with a larger particle size distribution Dw50 of about 200 um, it has a significantly higher bulk density, and the amount of sodium sulfate powder weighed for testing is about 200 grams.

1.3. Measure in a syringe about suitable amounts of a 72.5% active polymer paste containing an amphiphilic graft polymer of the present invention, which is dissolved in tripropylene glycol. This polymer has a polyethylene oxide backbone grafted with polyvinyl acetate side chains and is characterized by a number average molecular weight of about 28000 Daltons.

1.4. The powder is placed in a small Kenwood food mixer (Mini Chopper/Mill CH180A). A hole can be drilled on top of the mixer in location where the blades can chop the paste as it is being added.

1.5. Turn on the mixer and allow the powder to be stirred at a speed of class 6 for 2 seconds prior to adding the polymer paste. The polymer paste is then added using the syringe at approximately 1.8 gram/second. The mixer continues to operate at the same speed for approximately 1 second after all the paste has been added.

1.6. The resulting agglomerate is then sieved through a 1.4 mm U.S. Standard (ASTM E 11) sieve (#14) for 1 minute. Oversized particles that are retained on the screen and the remaining agglomerates that pass through the screen are weighed separately. The amount of oversized particles (%) is calculated by:

$$\%\ \text{Oversized} = \frac{\text{Weight of Oversized Particles}}{\text{Weight of Oversized Particles} + \text{Weight of the Passed Agglomerates}} \times 100\%$$

1.7. Five (5) data points representing different polymer/powder weight ratios are selected to quantify the saturation capacity of each powder. Weigh 2 different amounts of polymer paste in syringes. Each amount of polymer is added to a new batch of pre-weighed powder as described hereinabove. A good example where one has acquired a suitable estimate of the saturation capacity is when at least one data point is below the saturation limit (forming agglomerates with <10% oversized particles) and another data point is above the saturation limit (forming agglomerates with >10% oversized particles). Weigh another 3 different amounts of polymer paste separately, in addition to the initially selected 2 data points, and the polymer amounts are selected to achieve predefined polymer/powder weight ratios. Ideally, out of the 5 data points selected, the first 2 data points will be below the saturation point of the powder; the third data point is close to the powder saturation point; and the fourth and fifth data points are above the saturation point.

1.8. The 5 data points are then plotted to form a graph, with the amounts of oversized particles (%) plotted along the Y-axis, and the polymer/powder weight ratios plotted along the X-axis.

1.9. Using a least square curve fit, the saturation capability or loading capacity curve for a specific powder is drawn based on the 5 data points so plotted. FIG. 1 shows the saturation capability curves of both zeolite and sodium sulfate.

1.10. The saturation capability or loading capacity of a specific powder in relation to the polymer paste is determined as the polymer/powder weight ratio on the saturation capability curve when the amount of oversized particle is about 10%.

For example, for zeolite powder, the five data points are selected as: (1) 6 grams of polymer paste and 50 grams of zeolite powder; (2) 19.92 grams of polymer paste and 50 grams of zeolite powder; (3) 8.1 grams of polymer paste and 50 grams of zeolite powder; (4) 16.58 grams of polymer paste and 50 grams of zeolite powder; and (5) 23.5 grams of polymer paste and 50 grams of zeolite powder. All five (5) polymer and zeolite combinations are separately agglomerated in the mixer according to Steps 1.1-1.5 described hereinabove, and then the amount of oversized particles (%) is calculated for each of the combination according to Step 1.6. The test results are then plotted to generate a zeolite saturation capability curve as shown in FIG. 1, according to Steps 1.8-1.10.

For another example, for sodium sulfate powder, the five data points are selected as: (1) 6.25 grams of polymer paste and 50 grams of sodium sulfate powder; (2) 11.64 grams of polymer paste and 50 grams of sodium sulfate powder; (3) 7.83 grams of polymer paste and 50 grams of sodium sulfate powder; (4) 9.95 grams of polymer paste and 50 grams of sodium sulfate powder; (5) 13.8 grams of polymer paste and 50 grams of sodium sulfate powder. All five (5) polymer and sodium sulfate combinations are separately agglomerated in the mixer according to Steps 1.1-1.5 described hereinabove, and then the amount of oversized particles (%) is calculated for each of the combination according to Step 1.6. The test results are then plotted to generate a sodium sulfate saturation capability curve as shown in FIG. 1, according to Steps 1.8-1.10.

Base on the loading capacity (or saturation capability) curves of FIG. 1, the calculated saturation capability of zeolite powder at the 10% oversized particle rate (i.e., with particle size >1.4 mm) is about 0.329, while the calculated saturation capability of sodium sulfate powder at the same oversized particle rate is 0.043.

Conclusion: Zeolite powder has a loading capacity or saturation capability for the amphiphilic graft copolymer which is 666% higher than that of sodium sulfate at the same oversized particle rate of 10%.

Example 2

Comparative Test Showing Percentage Oversized Particle Generated Using Zeolite or Sodium Sulfate 2.1. A first sample ("Comparative Sample") is made by agglomerating 126 grams of the amphiphilic graft polymer which is 72.5% active (same as that used in Example 1) that is provided at a controlled temperature of about 60° C. with 194 grams of sodium carbonate particles that has a particle size distribution D(50) of about 80 um and 80 grams of zeolite particles that has a particle size distribution D(50) of about 4 um in a BRAUN CombiMax K600 food mixer at a mixing speed of class 8. The polymer paste is added using a syringe at approximately 1.8 gram/second. The mixer is stopped 1 second after all of the polymer paste has been added. The resulting agglomerates have a total weight of about 400 grams with a polymer activity of about 22.84%.

2.2. A second sample ("Inventive Sample") is made by agglomerating 120 grams of the same amphiphilic graft polymer which is 72.5% active (same as that used in Example 1) that is provided at a controlled temperature of about 60° C. with 200 grams of sodium carbonate particles (same as that described in paragraph 2.1) and 80 grams of sodium sulfate particles (same as that described in paragraph 1.2 or that has a particle size distribution of Dw50 of about 200 um) in the same food mixer as described hereinabove at the same speed of class 8. The polymer paste is added using a syringe at approximately 1.8 gram/second. The mixer is stopped 1 second after all of the polymer paste has been added. The resulting agglomerates have a total weight of about 400 grams with a polymer activity of about 21.75%.

2.3. The initial raw material proportions and the final compositional breakdowns of the Comparative Sample and Inventive Sample are tabulated as follows:

TABLE I

| Raw Materials | Comparative Sample | Inventive Sample |
|---|---|---|
| Polymer paste (72.5% active) | 31.50% | 30.00% |
| Carbonate | 48.50% | 50.00% |
| Zeolite | 20.00% | 0.00% |
| Sodium Sulfate | 0.00% | 20.00% |
| Total | 100.00% | 100.00% |

TABLE II

| Final Composition | Comparative Sample | Inventive Sample |
|---|---|---|
| Amphiphilic graft polymer | 22.84% | 21.75% |
| Carbonate | 48.50% | 50.00% |
| Zeolite | 20.00% | 0.00% |
| Sodium Sulfate | 0.00% | 20.00% |
| Misc./Water | 8.66% | 8.25% |
| Total | 100.00% | 100.00% |

2.4. The amount of oversized particles with particle sizes >1180 μm is then measured for both the Inventive Sample and the Comparative Sample. Specifically, the resulting agglomerates are sieved through a 1.18 mm U.S. Standard (ASTM E 11) sieve (#16) for 1 minute. Oversized particles that are retained on the screen and the remaining of the agglomerates that pass through the screen are weighed separately.

2.5. The respective amount of oversized particles in the Comparative Sample or the Inventive Sample is calculated by:

$$\%\ \text{Oversized} = \frac{\text{Weight of Oversized Particles}}{\text{Weight of Oversized Particles} + \text{Weight of the Passed Agglomerates}} \times 100\%$$

2.6. The measurement results are shown as below:

TABLE III

| | Comparative Sample | Inventive Sample |
|---|---|---|
| Percentage of oversized particles (>1180 um) | 28% | 32% |

2.7. The above test results show that the percentage of oversized particles in the Inventive Sample (containing 20 wt % sodium sulfate) is comparable to that of the Comparative Sample (containing 20 wt % zeolite), even though the previous Example 1 shows that zeolite has a loading capacity or saturation capability that is significantly higher than that of sodium sulfate (i.e., by 666%).

Example 3

Comparative Test Showing Flowability of Structured Particles Containing Zeolite or Sodium Sulfate The following comparative test is carried out to demonstrate the flowability differences between the Comparative Sample and the Inventive Sample described hereinabove in Example 2.

3.1. The device adapted for this test is a commercially available flowability testing system, Flodex™ (Hanson Research, Chatsworth, Calif., USA), which contains a flat-bottom cylindrical hopper with a removable bottom and a set of interchangeable bottom disks containing therein orifices of different sizes. Further, additional bottom disks with orifices of smaller sizes (with diameters below 4 mm) are made so as to provide a more complete range of orifice diameters including 3.0 mm, 3.5 mm, 4.0 mm, 5.0 mm, 6.0 mm, 7.0 mm, 8.0 mm, 9.0 mm, 10.0 mm, 12.0 mm, 14.0 mm.

Figure 2:
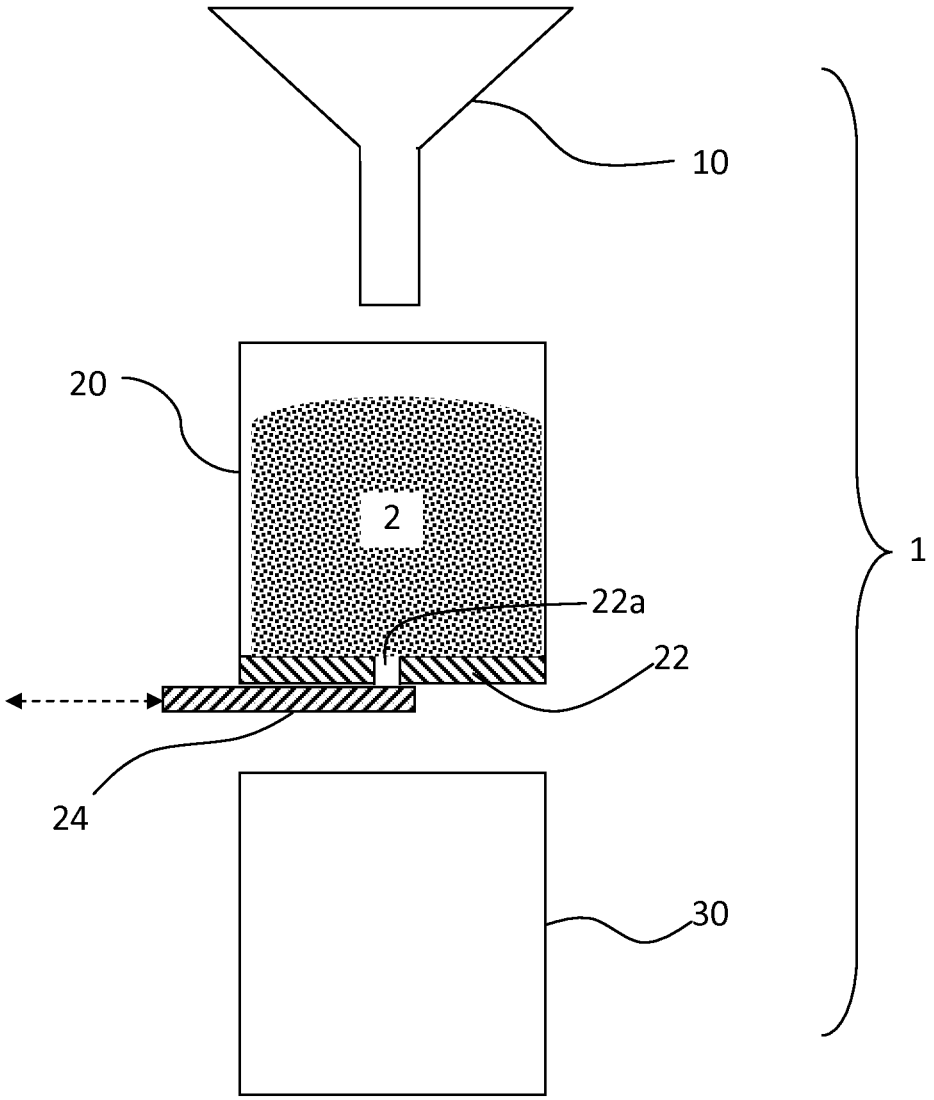
FIGS. 2 and 3 are cross-sectional diagrams illustrating how a FlowDex equipment can be used to measure flowability of polymer agglomerates formed according to the present invention.
Figure 3:
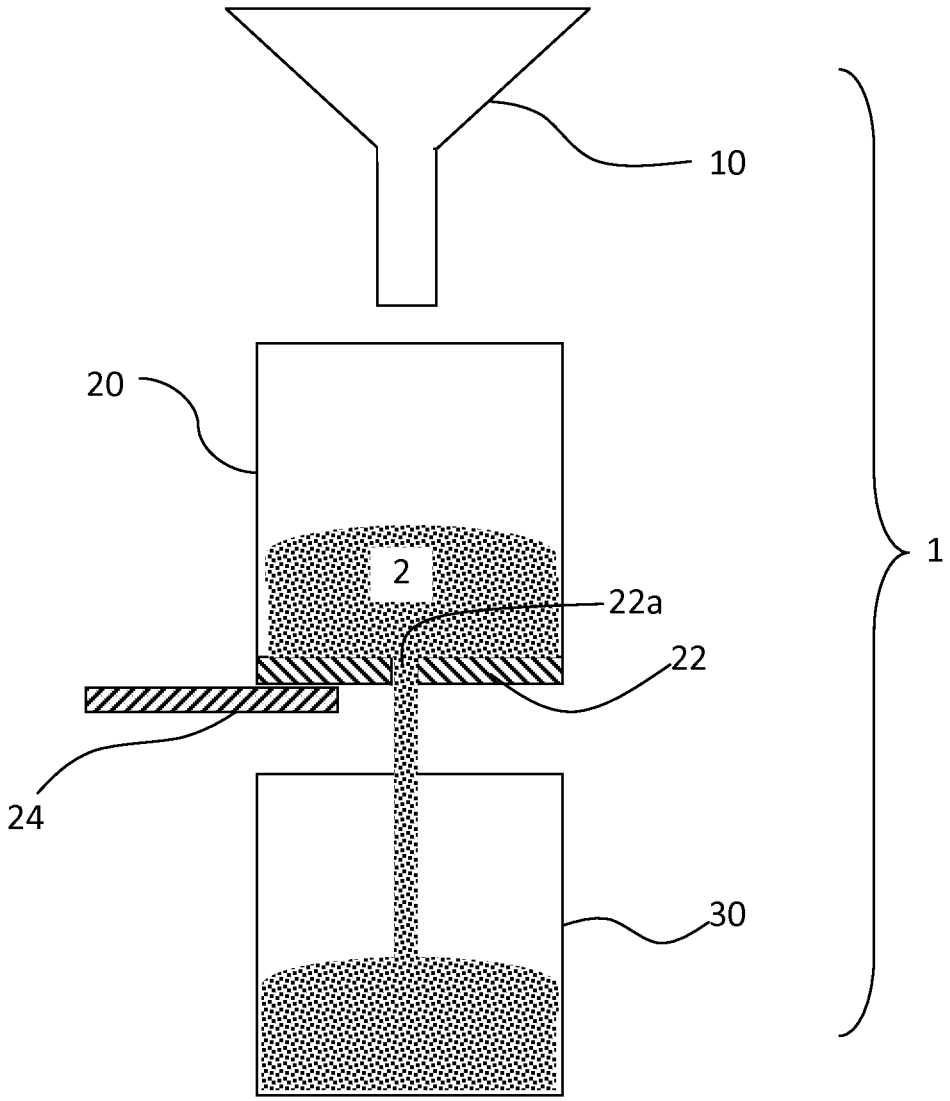

3.2. FIGS. 2 and 3 are cross-sectional diagrams illustrating how the FlowDex equipment functions to carry out the flowability measurement. Specifically, the FlowDex equipment 1 includes a funnel 10 for loading a particulate test sample 2 into a stainless steel flat-bottom cylindrical hopper 20 having a diameter of about 5.7 cm. The hopper 20 has a removable bottom defined by a removal bottom disk 22 with an orifice 22*a* of a specific size therein. Multiple removal bottom disks (not shown) having orifices of different sizes are provided, as mentioned hereinabove, which can be interchangeably fit at the bottom of hopper 20 in place of disk 22 to thereby define a bottom orifice of a different size from 22*a*. A discharge gate 24 is placed immediately underneath the orifice 22*a* and above a receiver 30, as shown in FIG. 2. When the flowability measurement starts, the discharge gate 24 is moved so as to expose the bottom orifice 22*a* and allow the particulate test sample 2 to flow from the hopper 20 through the bottom orifice 22*a* down to the receiver 30, as shown in FIG. 3.

3.3. To test the flowability of a specific test sample, the following steps are followed:

a. Fill the hopper 20 by pouring about 125 ml of the test sample through funnel 10. The sample fills the 5.7 cm-diameter hopper 20 to a height of about 5 cm.

b. After the sample settles, open the spring-loaded discharge gate 24 and allow the sample to flow through the orifice 22*a* into the receiver 30.

c. Steps (a) and (b) are repeated for the same test sample using different bottom disks having orifices of gradually increasing orifice sizes. At the beginning when the bottom disks with relatively smaller orifices are used, the flow of the test sample typically stops at some point due to jamming, i.e., it cannot pass through the orifice due to the small orifice size. Once the flow of test sample stops and remains stopped for 30 seconds or more, a jam is declared, and the specific bottom disk causing the jam is removed and replaced by another bottom disk with an orifice that is slightly larger for another repeat of steps (a) and (b). When the test sample is able to flow completely through an orifice of a specific size for three (3) consecutive times without jamming, such orifice size is recorded as the FlowDex Blockage Parameter of the sample tested. The smaller the FlowDex Blockage Parameter, the better the flowability of the test sample (i.e., it can flow through smaller orifices without jamming).

3.4. Following are the flowability test results:

| | Comparative Sample (<1180 um) | Inventive Sample (<1180 um) |
|---|---|---|
| FlowDex Blockage Parameter | 18 mm | 18 mm |

3.5. The test results show that flowability of the Inventive Sample (containing 20 wt % sodium sulfate) is the same as that of the Comparative Sample (containing 20 wt % zeolite), even though the previous Example 1 shows that zeolite has a loading capacity or saturation capability that is 666% higher than that of sodium sulfate.

Example 4

Exemplary Formulations of Granular Laundry Detergent Compositions

| Ingredient | Amount |
|---|---|
| Structured Particles of the Present Invention | from about 1 wt % to about 10 wt % |
| Amylase (Stainzyme Plus ®, having an enzyme activity of 14 mg active enzyme/g) | from about 0.1 wt % to about 0.5 wt % |
| Anionic detersive surfactant (such as alkyl benzene sulphonate, alkyl ethoxylated sulphate and mixtures thereof) | from about 8 wt % to about 15 wt % |
| Non-ionic detersive surfactant (such as alkyl ethoxylated alcohol) | from about 0.5 wt % to 4 wt % |
| Cationic detersive surfactant (such as quaternary ammonium compounds) | from about 0 wt % to about 4 wt % |
| Other detersive surfactant (such as zwiterionic detersive surfactants, amphoteric surfactants and mixtures thereof) | from about 0 wt % to 4 wt % |
| Carboxylate polymer (such as co-polymers of maleic acid and acrylic acid) | from about 1 wt % to about 4 wt % |
| Polyethylene glycol polymer (such as a polyethylene glycol polymer comprising poly vinyl acetate side chains) | from about 0 wt % to about 4 wt % |
| Polyester soil release polymer (such as Repel-o-tex and/or Texcare polymers) | from about 0.1 wt % to about 2 wt % |
| Cellulosic polymer (such as carboxymethyl cellulose, methyl cellulose and combinations thereof) | from about 0.5 wt % to about 2 wt % |
| Other polymer (such as amine polymers, dye transfer inhibitor polymers, hexamethylenediamine derivative polymers, and mixtures thereof) | from about 0 wt % to about 4 wt % |
| Zeolite builder and phosphate builder (such as zeolite 4A and/or sodium tripolyphosphate) | from about 0 wt to about 4 wt % |
| Other builder (such as sodium citrate and/or citric acid) | from about 0 wt % to about 3 wt % |
| Carbonate salt (such as sodium carbonate and/or sodium bicarbonate) | from about 15 wt % to about 30 wt % |
| Silicate salt (such as sodium silicate) | from about 0 wt % to about 10 wt % |
| Filler (such as sodium sulphate and/or bio-fillers) | from about 10 wt % to about 40 wt % |
| Source of available oxygen (such as sodium percarbonate) | from about 10 wt % to about 20 wt % |
| Bleach activator (such as tetraacetylethylene diamine (TAED) and/or nonanoyloxybenzenesulphonate (NOBS) | from about 2 wt % to about 8 wt % |
| Bleach catalyst (such as oxaziridinium-based bleach catalyst and/or transition metal bleach catalyst) | from about 0 wt % to about 0.1 wt % |
| Other bleach (such as reducing bleach and/or pre-formed peracid) | from about 0 wt % to about 10 wt % |
| Chelant (such as ethylenediamine-N'N'-disuccinic acid (EDDS) and/or hydroxyethane diphosphonic acid (HEDP) | from about 0.2 wt % to about 1 wt % |
| Photobleach (such as zinc and/or aluminium sulphonated phthalocyanine) | from about 0 wt % to about 0.1 wt % |
| Hueing agent (such as direct violet 99, acid red 52, acid blue 80, direct violet 9, solvent violet 13 and any combination thereof) | from about 0 wt % to about 0.5 wt % |

-continued

| Ingredient | Amount |
|---|---|
| Brightener (such as brightener 15 and/or brightener 49) | from about 0.1 wt % to about 0.4 wt % |
| Protease (such as Savinase, Polarzyme, Purafect, FN3, FN4 and any combination thereof, typically having an enzyme activity of from about 20 mg to about 100 mg active enzyme/g) | from about 0.1 wt % to about 1.5 wt % |
| Amylase (such as Termamyl ®, Termamyl Ultra ®, Natalase ®, Optisize HT Plus ®, Powerase ®, Stainzyme ® and any combination thereof, typically having an enzyme activity of from about 10 mg to about 50 mg active enzyme/g) | from about 0.05 wt % to about 0.2 wt % |
| Cellulase (such as Carezyme ®, Celluzyme ® and/or Celluclean ®, typically having an enzyme activity of from 10 to 50 mg active enzyme/g) | from about 0.05 wt % to about 0.5 wt % |
| Lipase (such as Lipex ®, Lipolex ®, Lipoclean ® and any combination thereof, typically having an enzyme activity of from about 10 mg to about 50 mg active enzyme/g) | from about 0.2 wt % to about 1 wt % |
| Other enzyme (such as xyloglucanase (e.g., Whitezyme ®), cutinase, pectate lyase, mannanase, bleaching enzyme, typically having an enzyme activity of from about 10 mg to about 50 mg active enzyme/g) | from 0 wt % to 2 wt % |
| Fabric softener (such as montmorillonite clay and/or polydimethylsiloxane (PDMS)) | from 0 wt % to 15 wt % |
| Flocculant (such as polyethylene oxide) | from 0 wt % to 1 wt % |
| Suds suppressor (such as silicone and/or fatty acid) | from 0 wt % to 0.1 wt % |
| Perfume (such as perfume microcapsule, spray-on perfume, starch encapsulated perfume accords, perfume loaded zeolite, and any combination thereof) | from 0.1 wt % to 1 wt % |
| Aesthetics (such as colored soap rings and/or colored speckles/noodles) | from 0 wt % to 1 wt % |
| Miscellaneous | Balance |

*All enzyme levels expressed as rug active enzyme protein per 100 g detergent composition.

Surfactant ingredients can be obtained from BASF, Ludwigshafen, Germany (Lutensol®); Shell Chemicals, London, UK; Stepan, Northfield, Ill., USA; Huntsman, Huntsman, Salt Lake City, Utah, USA; Clariant, Sulzbach, Germany (Praepagen®).

Sodium tripolyphosphate can be obtained from Rhodia, Paris, France.

Zeolite can be obtained from Industrial Zeolite (UK) Ltd, Grays, Essex, UK.

Citric acid and sodium citrate can be obtained from Jungbunzlauer, Basel, Switzerland.

NOBS is sodium nonanoyloxybenzenesulfonate, supplied by Eastman, Batesville, Ark., USA.

TAED is tetraacetylethylenediamine, supplied under the Peractive® brand name by Clariant GmbH, Sulzbach, Germany.

Sodium carbonate and sodium bicarbonate can be obtained from Solvay, Brussels, Belgium.

Polyacrylate, polyacrylate/maleate copolymers can be obtained from BASF, Ludwigshafen, Germany.

Repel-O-Tex® can be obtained from Rhodia, Paris, France.

Texcare® can be obtained from Clariant, Sulzbach, Germany.

Sodium percarbonate and sodium carbonate can be obtained from Solvay, Houston, Tex., USA.

Na salt of Ethylenediamine-N,N'-disuccinic acid, (S,S) isomer (EDDS) was supplied by Octel, Ellesmere Port, UK.

Hydroxyethane di phosphonate (HEDP) was supplied by Dow Chemical, Midland, Mich., USA.

Enzymes Savinase®, Savinase® Ultra, Stainzyme® Plus, Lipex®, Lipolex®, Lipoclean®, Celluclean®, Carezyme®, Natalase®, Stainzyme®, Stainzyme® Plus, Termamyl®, Termamyl® ultra, and Mannaway® can be obtained from Novozymes, Bagsvaerd, Denmark.

Enzymes Purafect®, FN3, FN4 and Optisize can be obtained from Genencor International Inc., Palo Alto, Calif., US.

Direct violet 9 and 99 can be obtained from BASF DE, Ludwigshafen, Germany.

Solvent violet 13 can be obtained from Ningbo Lixing Chemical Co., Ltd. Ningbo, Zhejiang, China.

Brighteners can be obtained from Ciba Specialty Chemicals, Basel, Switzerland.

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A structured particle comprising:

(a) from 10 wt % to 30 wt % of an amphiphilic graft copolymer comprising a polyalkylene oxide backbone grafted with one or more side chains selected from the group consisting of polyvinyl acetate, polyvinyl propionate, polyvinyl butyrate, and combinations thereof, wherein the amphiphilic graft copolymer has an average of no more than 1 graft site per 50 alkylenexoxide units;

(b) from 30 wt % to 80 wt % of a water-soluble alkali metal carbonate, which is in a particulate form characterized by a particle size distribution Dw50 ranging from 10 microns to 100 microns; and (c) from 10 wt % to 40 wt % of a water-soluble alkali metal sulfate, which is in a particulate form characterized by a particle size distribution Dw50 ranging from 50 microns to 250 microns, wherein said structured particle is characterized by a particle size distribution Dw50 ranging from 250 microns to 1000 microns and a bulk density ranging from 500 to 1500 g/L, and wherein said structured particle has a total surfactant level of from 0 wt % to 5 wt % and comprises from 0 wt % to 5 wt % of zeolite.

2. The structured particle of claim 1, comprising from 1 wt % to 3 wt % of a nonionic surfactant.

3. The structured particle of claim 2, wherein said nonionic surfactant is a $C_8$-$C_{16}$ alkyl alkoxylated alcohol or a $C_8$-$C_{16}$ alkyl alkoxylate.

4. The structured particle according to claim 1, characterized by a moisture content of less than 4% by total weight of said structured particle.

5. The structured particle according to claim 1, comprising from 0 wt % to 5 wt % of phosphate.

6. The structured particle according to claim 1, wherein the amphiphilic graft copolymer comprises a polyethylene oxide backbone, a polypropylene oxide backbone, a polybutylene oxide backbone, or a polymeric backbone that is a linear block copolymer of polyethylene oxide, polypropylene oxide, and/or polybutylene oxide.

7. The structured particle according to claim 1, wherein the amphiphilic graft copolymer comprises a polyethylene oxide backbone grafted with one or more side chains of polyvinyl acetate, and wherein the weight ratio of the polyethylene oxide backbone over the polyvinyl acetate side chains ranges from 1:0.2 to 1:10.

8. A structured particle comprising:

(a) from 20 wt % to 25 wt % of an amphiphilic graft copolymer comprising a polyethylene oxide backbone grafted with one or more side chains of polyvinyl acetate, wherein the amphiphilic graft copolymer has an average of no more than 1 graft site per 50 ethyleneoxide units and;

(b) from 40 wt % to 60 wt % of sodium carbonate particles having a particle size distribution Dw50 ranging from 180 microns to 220 microns;

(c) from 15 wt % to 25 wt % of sodium sulfate particles having a particle size distribution Dw50 ranging from 70 microns to 90 microns; and (d) from 2 wt % to 4 wt % of a nonionic surfactant that is a $C_8$-$C_{16}$ alkyl alkoxylated alcohol or $C_8$-$C_{16}$ alkyl alkoxylate, wherein said structured particle is characterized by a particle size distribution Dw50 ranging from 250 microns to 1000 microns and a bulk density ranging from 500 to 1500 g/L, and wherein said structured particle has a moisture content of less than 4 wt % and comprises less than 0.5 wt % of zeolite.

9. A granular detergent composition comprising from 1 wt % to 10 wt % of structured particles according to claim 8.

10. The granular detergent composition of claim 9, further comprising from 1 wt % to 99 wt % of one or more surfactants selected from the group consisting of anionic surfactants, cationic surfactants, nonionic surfactants, amphoteric surfactants, and mixtures thereof.

11. The granular detergent composition of claim 9, comprising at least one anionic surfactant selected from the group consisting of $C_{10}$-$C_{20}$ linear alkylbenzene sulphonates (LAS), $C_{10}$-$C_{20}$ linear or branched alkyl sulfates (AS), $C_{10}$-$C_{20}$ linear or branched alkylalkoxy sulfates having a weight average degree of alkoxylation ranging from 0.1 to 10, and mixtures thereof.

12. A method of forming structured particles, comprising the steps of:

(a) providing from 10 part to 30 parts, by a total weight of 100 parts, of an amphiphilic graft copolymer comprising a polyalkylene oxide backbone grafted with one or more side chains selected from the group consisting of polyvinyl acetate, polyvinyl propionate, polyvinyl butyrate, and combinations thereof, wherein the amphiphilic graft copolymer has an average of no more than 1 graft site per 50 alkylenexoxide units, wherein said amphiphilic graft copolymer is in a paste form; and (b) mixing the paste form of amphiphilic graft copolymer with from 30 parts to 80 parts of a water-soluble alkali metal carbonate and from 10 parts to 40 parts of a water-soluble alkali metal sulfate, by a total weight of 100 parts, to form structured particles, wherein the water-soluble alkali metal carbonate is in a particulate form having a particle size distribution Dw50 ranging from 10 microns to 35 microns, wherein the water-soluble alkali metal sulfate is in a particulate form characterized by a particle size distribution Dw50 ranging from 50 microns to 150 microns, wherein the structured particles so formed are characterized by a particle size distribution Dw50 ranging from 250 microns to 1000 microns and a bulk density ranging from 500 to 1500 g/L.

* * * * *